US005395117A

United States Patent [19]

Ogden

[11] Patent Number: 5,395,117

[45] Date of Patent: Mar. 7, 1995

[54] REVERSIBLE ARM MOVEMENT LIMITER METHOD

[76] Inventor: Robert L. Ogden, 700 Winsted La., Austin, Tex. 78703

[21] Appl. No.: 77,281

[22] Filed: Jun. 15, 1993

[51] Int. Cl.[6] ..... A63B 69/36

[52] U.S. Cl. ..... 273/189 A; 602/20; 273/189 R

[58] Field of Search ..... 273/187.2, 189 A, 189 R; 602/20

[56] References Cited

U.S. PATENT DOCUMENTS

| | | | |
|---|---|---|---|
| Re. 32,680 | 5/1988 | Pompa | 602/20 |
| 364,942 | 6/1887 | Lee | 602/20 |
| 1,457,710 | 6/1923 | MacDonald . | |
| 3,419,276 | 12/1968 | Poggioli . | |
| 3,884,478 | 5/1975 | Buzan . | |
| 3,900,199 | 8/1975 | McGonagle | 602/20 |
| 4,254,953 | 3/1981 | Marchetti . | |
| 4,489,716 | 12/1984 | Blackwood | 602/20 |
| 4,575,089 | 3/1986 | Corbett et al. | 273/183 B |
| 4,612,919 | 9/1986 | Best . | |
| 4,763,901 | 8/1988 | Richter | 602/20 |
| 4,911,728 | 3/1990 | Rigel | 273/189 A |
| 5,007,415 | 4/1991 | Marion | 273/189 R |
| 5,076,587 | 12/1991 | Manley | 273/183 B |

FOREIGN PATENT DOCUMENTS

| | | | |
|---|---|---|---|
| 903884 | 10/1945 | France | 602/20 |
| 182158 | 3/1907 | Germany | 602/20 |
| 1052230 | 11/1983 | U.S.S.R. | 602/20 |

*Primary Examiner*—Mark S. Graham
*Attorney, Agent, or Firm*—Shaffer & Culbertson

[57] ABSTRACT

A method of limiting arm movement using a reversible arm movement limiter having a first curvate brace section joined to a second curvate brace section. A removably attachable fastener for securing the curvate section to a user is provided as well. In a preferred embodiment, the first currate brace section is shorter in longitudinal length than the second, longer, curvate brace section and the removably attachable fastener is attached to the longer section. Both curvate brace sections are curved so as to more nearly conform to the form of a user's upper and lower arm. The fastener of a preferred embodiment includes at least one stretchable elastic band with two ends. The first end is attached to the longer curvate brace section at one end. A free end is free to stretch around the user's arm. To secure it in place, the invention incorporates the use of hook and loop material so that the free end is removably attachable and infinitely adjustable. As a result, the arm movement limiter of the invention is attached to a single portion of the user's arm, either upper or lower, and is reversible at the limb of the user. Further, the arm limiter of the invention has no moving parts that can pinch the user or wear out and is usable by fight- and left-handed golfers without requirement of modification or adjustment. In a preferred embodiment, the first and second curvate sections are joined at right angles so that the arm is limited in movement up to but not beyond 90°, the desired maximum movement of a golfer's following arm. The device may be attached, however, so as to provide for an angle of less than or more than 90° if desired.

1 Claim, 1 Drawing Sheet

REVERSIBLE ARM MOVEMENT LIMITER METHOD

BACKGROUND OF THE INVENTION

This invention relates to a reversible arm movement limiter apparatus and method.

A huge variety of devices have been developed and known in the art for quite some time for use in assisting and/or limiting the movement a user may make from that which the body can make without such a device. In particular, with regard to sports endeavors, it is known that there are a number of movements that the human body can make that are not beneficial to the desired result. In particular, with regard to a golf swing, a correct swing is a most "unnatural" endeavor. For example, a major focus in golfing education is to "keep the left arm straight." Examples of devices designed to do just that are disclosed in MacDonald U.S. Pat. No. 1,457,710; Buzan U.S. Pat. No. 3,884,478; Marchetti U.S. Pat. No. 4,254,953; Corbett et al. U.S. Pat. No. 4,575,089; and Poggioli U.S. Pat. No. 3,419,276. MacDonald discloses a complicated piston-like device designed to keep the left arm straight. In golf, for right-handed golfers, the left arm is the arm that should be kept straight. For left-handed golfers it would be the fight arm. For right-handed golfers, the fight arm is called the following arm. For left-handed golfers, the left arm is the following arm.

Poggioli and Buzan both disclose inventions designed to assist in keeping the left arm straight for right-handed golfers, and to provide an audio signal when the left arm strays from the straight position. Marchetti discloses a device that assists in keeping the left arm straight. Some motion is allowed in Marchetti; however, once the back swing has been completed, according to Marchetti, the elbow is controlled against further rotation thereafter. Marchetti's device is simpler than others but still comprises a variety of moving parts capable of failure. The Corbett et al. patent discloses a particular design for keeping the left arm straight for right-handed golfers, but most importantly, for assisting with "pronation" of the left arm at the end of the swing.

None of these prior art devices addresses the issue of ensuring that the golfer's following arm is in the correct position during the critical points of the golf stroke.

The Manley patent, U.S. Pat. No. 5,076,587, does attempt to help the golf swing by focusing on the following arm. The Manley device, however, is a movable pivoting device that is attached at three places on the following arm. The device enables free movement of the right arm throughout the back swing and follow through while the various pieces of the device rotate or pivot. This device requires attachment at multiple points including the elbow, the forearm, and the upper arm in order for it to function properly. Additionally, it includes moveable parts which could break and potentially pinch the golfer or get entangled with the golfer's clothing while completing a proper golf swing. Further, it does not disclose any intermediary positions, only 90°.

A drawback to the golf training and motion restriction devices known in the art is that they generally include, as discussed above, a variety of complicated moving parts that can break, pinch, wear out, and generally cause more trouble than they are worth. Further, invariably they involve a complicated attachment process to the golfer so that the golfer is put off from using them simply by the difficulty in actually attaching the device to the user's body. Thus, there is a need in the art for providing an arm movement limiting device that is simple, easy to use, has limited moving parts, if any, and is attached to the golfer at as few places as possible while still accomplishing its stated purpose of movement limitation. It, therefore, is an object of this invention to provide an arm movement limiter which is easy to use, attached to only one portion of the user's arm, and which indicates an improper movement simply and without moving mechanical parts.

SHORT STATEMENT OF THE INVENTION

Accordingly, the reversible arm movement limiter of the present invention includes a first curvate brace section, a second currate brace section joined to the first, and a removably attachable fastener for securing the curvate section to a user at a single location. In a preferred embodiment, the first curvate brace section is shorter in longitudinal length than the second longer curvate brace section and the removably attachable fastener for securing the currate sections to the user is attached to the longer curvate brace section. As a result, the arm limiter of the present invention can be attached to the forearm, i.e., below the elbow, or to the upper arm, i.e., above the elbow, without requirement of any change except for reversing the apparatus. Also in a preferred embodiment, the fastener includes at least one stretchable elastic band connected at one end to the longer curvate brace section. Hook and loop material is attached to the first end and a second free end is free to stretch around the user's arm. The second free end also is covered with hook and loop material so that once it has been stretched around the user, it can be joined to the first end hook and loop material to securely attach the invention to the user. The curvate sections are joined at right angles so that the forearm of the user feels when it bends to a 90° angle throughout the course of the swing and permits the user to feel through are of movement the 90° angle is maintained. At the same time the user's following arm is free to move and free from encircling attachments other than at a single portion of the user's arm. Further, the placement of the shorter curvate section will permit an angle other than 90° to be selected if the user wishes.

BRIEF DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
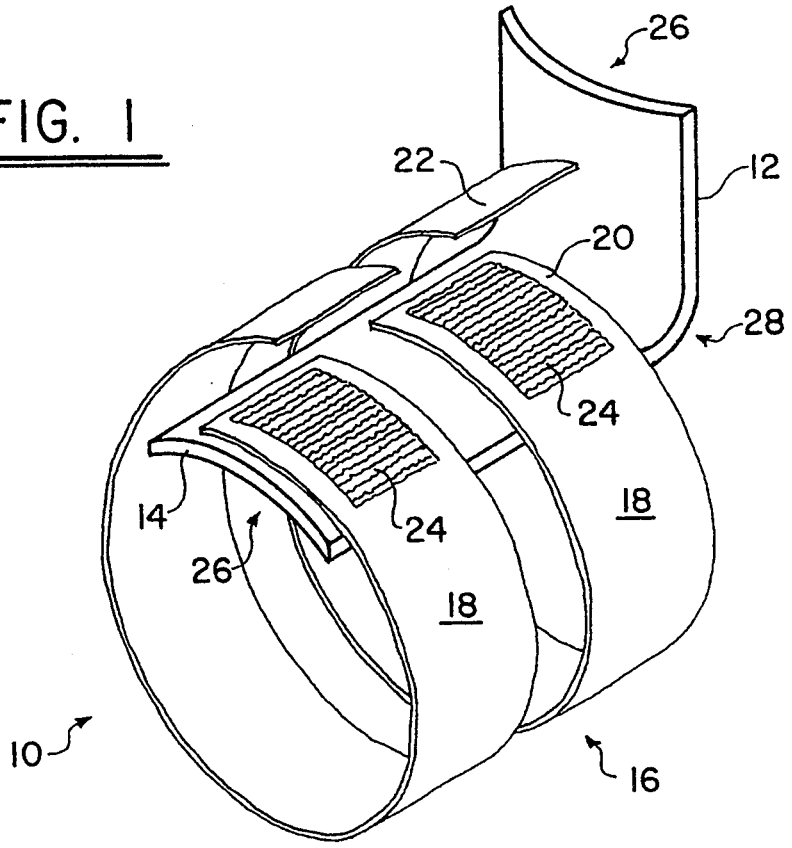
FIG. 1 is a perspective view of a preferred embodiment of the reversible arm movement limiter of the present invention.
Figure 2:
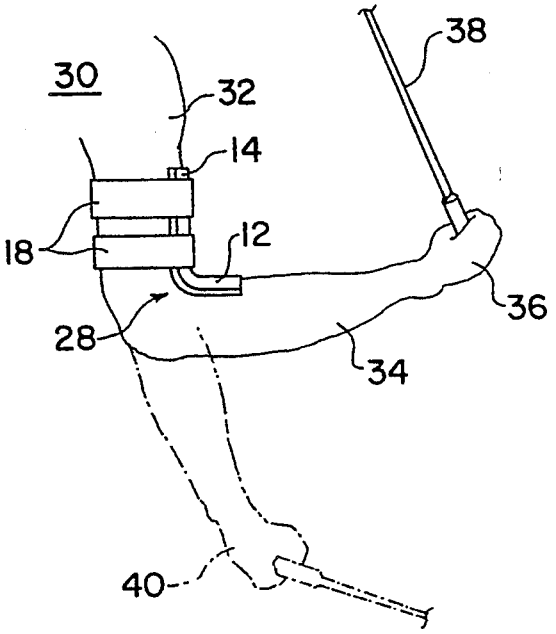
FIG. 2 is a side view showing the limiter attached to the upper arm of the user with the lower arm free from attachment.
Figure 3:
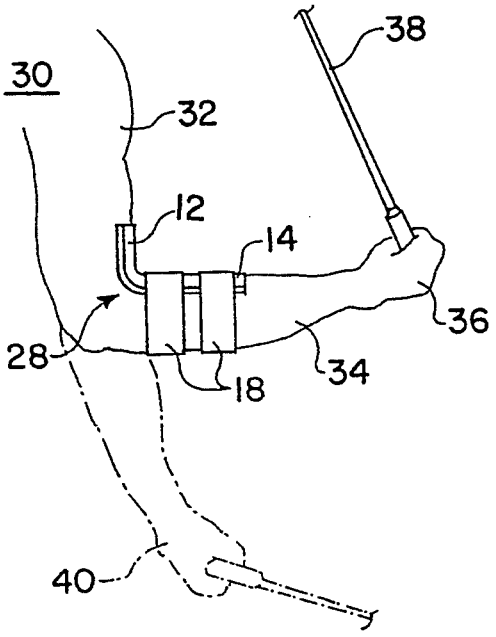
FIG. 3 is a side view showing the arm limiter attached to the lower arm or forearm with the upper arm free.

The preferred embodiment of the present invention is illustrated by way of example in FIGS. 1–3. With specific reference to FIG. 1, a reversible arm movement limiter 10 includes a first currate brace section 12 and a second currate brace section 14. Further, a removably attachable fastener 16 is provided.

As shown in FIGS. 1–3, in a preferred embodiment the first curvate brace section 12 is shorter in longitudinal length than the second currate brace section 14 and the removably attachable fastening means 16 is attached to longer curvate brace section 14.

In a preferred embodiment, removably attachable fastener 16 consists of at least one stretchable elastic band 18 formed of any suitable stretchable material such as elastic, plastic, and so forth. Stretchable elastic band 18, or any other suitable strap, is attached to reversible arm movement limiter 10 by any means known in the art including glue, rivets, staples, stitching, and so forth. Stretchable elastic band 18 has two ends, an attached end 20 and a free end 22. Attached end 20 is attached to currate brace section 12 or 14, again, by any means known in the art. Additionally, attached end 20 and free end 22 have hook and loop material 24 attached to them (hook and loop material 24 is not shown on free end 22 in the figures). As result, when free end 22 is stretched around the user's arm, and the hook and loop material 24 is brought in contact with the hook and loop material on attached end 20, a removably attachable securing fastener 16 is achieved.

Still referring to FIG. 1, both first curvate brace section 12 and second curvate brace section 14 show a curve 26 that, as can be seen by reference to FIGS. 2 and 3, will conform easily to the shape of the user's forearm and upper arm when in use. Further, currate brace sections 12 and 14 may be formed of a single cast piece.

As also shown in FIGS. 1–3, in a preferred embodiment, first currate brace section 12 is joined to second curvate brace section 14 at a curving fight angle highlighted by arrow 28.

Referring now to FIG. 2, user 30 has an upper arm 32, lower arm 34, and hand 36 in which is held club 38. FIG. 2 shows a preferred embodiment of reversible arm movement limiter 10 attached by removably attachable fastener 16 in the form of stretchable elastic bands 18 to user's 30 upper arm 32. No other attachment to user 30 is necessary to effect the full purpose of the invention. Neither are there any moving parts to the invention. As shown by dotted silhouette 40, when the user's 30 forearm 34 is raised, it will have freedom of motion up to the point that the forearm contacts the first curvate brace section 12. At that point, the user's forearm 34 will be prevented from moving beyond the angle created by the joining of brace sections 12 and 14, i.e., a fight angle, and the user can feel and know the desired following angle has been reached.

Referring now to FIG. 3, the reversible arm movement limiter 10 is shown reversed so that it is attached by stretchable elastic bands 18 to user's 30 forearm 34. No other attachment is necessary for the proper utilization of the invention. In FIG. 3, referring to dotted silhouette 40, it can be seen that as the user 30 moves his or her arm from the dotted silhouette 40 position to the solid line position shown in FIG. 3, that first curvate brace section 12 will move freely until in comes into contact with user's 30 upper arm 32. At that point, user 30 will be limited in further movement of his or her arm and will be aware that the arm has reached the desired angle of bend.

The apparatus of the present invention, therefore, incorporates no moving parts other than removably attachable fastener 16. In a preferred embodiment, removably attachable fastener 16 is comprised of stretchable elastic bands 18 with attached end 20 connected to the device. In a preferred embodiment, stretchable attached end 20 is attached to the second, longer currate brace section 14. Further in a preferred embodiment, at least one stretchable elastic band 18 is utilized and, as shown in the FIG. 2, is attached to only one area of the user's arm.

Importantly, the golfer need not worry that the device is limited to right-handed players. Left-handed golfers can use the device as easily as right-handed golfers. A purpose of the invention is to achieve the limiting of the movement of the following arm, again, for left-handed golfers, the left arm, and for right-handed golfers, the right arm. It has been determined by golf pros and others that it is helpful to a proper golf swing that the following arm flex no more than 90° during a correct swing and that it be held in that position during a period of the back swing and somewhat into the forward swing. Because of the attachment of the device to the user, the user can feel when his or her following arm is in the correct position and maintain it in this position as long as necessary for a correct swing.

By means of the apparatus of the present invention, the reversible arm movement limiter 10 can be attached to the upper arm 32 while the lower arm 34 is totally unencumbered. On the other hand, the device can be, at the user's discretion, attached to the lower arm while keeping the upper arm free. The device can be permanently formed in angles greater or less than 90° to fit an individual user's needs. Importantly, the 90° device can be used itself to cause the user's arm to form an angle greater or less than 90° simply by placement of the device on the user's arm. That is, if it is placed in front of the elbow it will deter, or contact the user, at an angle less than 90°. If you place it behind the elbow, more than 90° will be allowed. The user can, therefore, modify it at will. During a golf swing the right arm (following arm) begins in a semi bent position. During the back swing the right arm bends to an "ell" position close to 90°, but this varies according to the individual. Some people, due to their musculature, will not reach 90° and some will form an acute angle less than 90°. This device accommodates this variance of degrees. This is accomplished by folding the arm to the desired angle and then attaching the device so that the shorter curvate brace section touches the arm as it is folded to the desired angle. Trial and error, and professional instruction, will indicate the most desirable angle.

The removable arm movement limiter 10 of the present invention is curved, as shown by curve 26 in FIG. 1 so that it more nearly conforms to the outward rounded curvature of a user's upper and lower arm. Thus, the reversible arm movement limiter 10 of the present invention includes no moving parts and yet accomplishes the function of the arm movement limiter simply and without undue restriction or attachment to various parts of the user's anatomy.

Even though the device is curved to conform to the user's body, a unique feature is that if too much pressure is asserted the user's arm will twist or turn the device on the arm so the arm is not injured.

A method of limiting arm movement is also disclosed which includes the step of providing a first curvate brace section 12 and attaching a second curvate brace section 14 to the first. Thereafter, a removably attachable fastening device is provided for securing the currate sections to a user and, finally, the user simply secures the curvate section to the desired upper or lower arm and arm movement limitation is limited to that up to but not beyond a 90° movement.

While the present invention has been disclosed in connection with the preferred embodiment thereof, it should be understood that there may be other embodiments which fall within the spirit and scope of the invention as defined by the following claims.

I claim:

1. A method of limiting arm movement comprising the steps of:

a) providing a first curvate brace section;

b) attaching a second curvate brace section to the first curvate brace section at an angle, the second curvate brace section longer than the first curvate brace section;

c) providing a removably attachable fastening means for securing only the second curvate section to a user's arm; and d) securing only the second curvate section to an inner portion of a user's arm above a user's elbow so that the user's arm may freely bend at the elbow between an extended, substantially straight position and a limit position wherein the first curvate brace section, that is unattached to the user's arm, prevents the user's arm from bending at the elbow beyond the limit position.

* * * * *